US009387582B2

(12) United States Patent
Voves

(10) Patent No.: US 9,387,582 B2
(45) Date of Patent: Jul. 12, 2016

(54) MAGNETIC HOLDING DEVICE AND METHOD OF USE

(71) Applicant: JAVCO L.L.C., Cresco, IA (US)

(72) Inventor: Mark A. Voves, Cresco, IA (US)

(73) Assignee: INNOVATIONS UNLIMITED L.L.C., Cresco, IA (US)

( * ) Notice: Subject to any disclaimer, the term of this patent is extended or adjusted under 35 U.S.C. 154(b) by 73 days.

(21) Appl. No.: 13/786,595

(22) Filed: Mar. 6, 2013

(65) Prior Publication Data

US 2013/0240694 A1 Sep. 19, 2013

Related U.S. Application Data

(60) Provisional application No. 61/610,172, filed on Mar. 13, 2012.

(51) Int. Cl.

| | |
|---|---|
| ***A47G 1/17*** | (2006.01) |
| ***B25H 3/00*** | (2006.01) |
| *A45F 5/00* | (2006.01) |

(52) U.S. Cl.

CPC ..... *B25H 3/00* (2013.01)

(58) Field of Classification Search

CPC .... B25H 3/00; B29C 65/785; B29C 65/8284; A47G 1/17; F16M 13/02; F16M 13/022

USPC ..... 248/206.5, 309.4, 228.8, 230.8, 74.3; 24/16 PB; 269/8, 6, 3; 224/183, 584, 224/217–222, 904

See application file for complete search history.

(56) References Cited

U.S. PATENT DOCUMENTS

| | | | | | |
|---|---|---|---|---|---|
| 2,176,052 | A | * | 10/1939 | Beyer | A44C 5/0046 132/331 |
| 3,536,285 | A | * | 10/1970 | Vaughn | 248/309.4 |
| 3,999,465 | A | * | 12/1976 | Burnight | F01B 1/0644 91/498 |
| 4,456,255 | A | * | 6/1984 | Braunhut | 463/47.7 |
| 4,572,145 | A | * | 2/1986 | Mitchell | F02M 27/045 123/536 |

(Continued)

OTHER PUBLICATIONS

Rare Earth Solutions; Zip Holders, Magnetic Zip Tie Holder—Large Magnetic Zip Tie Holder—Small Magnetic Zip Tie Holder, & Small Magnetic Zip Tie Holder (Rectangle Magnet); May 21, 2012; http://www.rareearthsolutions.com/rare_earth_solutions_006.htm.

*Primary Examiner* — Jonathan Liu
*Assistant Examiner* — Muhammad Ijaz
(74) *Attorney, Agent, or Firm* — Zarley Law Firm, P.L.C.

(57) ABSTRACT

A magnetic holding device having an elongated body which extends between a tip and a locking head. A saddle is connected to the elongated body. Said saddle having a magnet connected thereto. In operation the elongated body is wrapped around the body of a hand tool and the tip is passed through an opening in the locking head. The elongated body is passed through the locking head until the magnetic holding device is tightened over the hand tool. Once in place the magnetic holding device holds the hand tool in a convenient place near where the hand tool is being used by connecting the magnet to any metal object. In this way the magnetic holding device provides the advantage of reducing the potential for lost or misplaced hand tools by allowing for easy organization and placement of hand tools during use.

20 Claims, 4 Drawing Sheets

(56) References Cited

U.S. PATENT DOCUMENTS 4,708,306 A * 11/1987 Mitomi ..... F16B 2/08 24/16 PB
4,808,306 A * 2/1989 Mitchell ..... C02F 1/482 123/538
5,025,966 A * 6/1991 Potter ..... A45F 5/02 224/183
5,201,444 A * 4/1993 Simonet ..... A45F 5/00 224/183
5,359,979 A * 11/1994 Anfinson ..... F02M 27/045 123/538
5,457,853 A * 10/1995 Klein ..... 24/16 PB
5,558,765 A * 9/1996 Twardzik ..... F02M 27/045 123/538
5,593,121 A * 1/1997 Tackett ..... F41B 5/06 124/25.5
5,642,871 A * 7/1997 Repert ..... A47K 5/05 248/206.5
5,895,018 A * 4/1999 Rielo ..... A47K 10/12 248/206.5
6,343,693 B1 * 2/2002 Finley ..... A45F 5/00 206/338
6,640,394 B1 * 11/2003 Berrocal ..... B65D 63/1063 24/16 PB
6,895,642 B2 * 5/2005 Huang ..... A47G 1/17 24/303
6,972,649 B1 * 12/2005 Murthy et al. ..... 335/42
7,360,281 B1 * 4/2008 MacCartey ..... B65D 63/1063 24/16 PB
7,544,889 B1 * 6/2009 Sanchez ..... 174/58
7,568,665 B2 * 8/2009 Corbin ..... H02G 3/30 248/547
7,699,277 B2 * 4/2010 Bagnall ..... A01K 63/006 119/230
7,810,265 B2 * 10/2010 Beatty ..... G09F 7/18 116/173
7,987,761 B2 * 8/2011 Butler ..... E05B 43/00 24/16 PB
8,479,685 B2 * 7/2013 Sprung ..... A01K 63/006 119/51.04
2004/0089688 A1 * 5/2004 Perez ..... A45F 5/00 224/666
2004/0245415 A1 12/2004 Sun
2005/0156085 A1 * 7/2005 Radovan ..... A46B 17/02 248/110
2005/0283952 A1 * 12/2005 Talbot ..... A45F 5/00 24/300
2009/0145938 A1 * 6/2009 Kahn ..... A45F 5/02 224/183
2010/0083699 A1 * 4/2010 Conigliaro ..... A44C 15/003 63/1.18
2010/0264758 A1 * 10/2010 Strohm et al. ..... 310/43
2010/0265176 A1 * 10/2010 Olsson ..... G05G 5/05 345/161
2011/0062812 A1 * 3/2011 Horng et al. ..... 310/156.22
2013/0074803 A1 * 3/2013 Murray ..... F02M 27/045 123/456

* cited by examiner

MAGNETIC HOLDING DEVICE AND METHOD OF USE

CROSS REFERENCE TO RELATED APPLICATION

This application claims the benefit of U.S. Provisional Application No. 61/610,172 filed Mar. 13, 2012.

FIELD OF THE INVENTION

This invention relates to a magnetic holding device. More specifically, and without limitation, this invention relates to a magnetic holding device that attaches to hand tools and a variety of other objects so as to provide a way to magnetically hold them in place.

BACKGROUND OF INVENTION

Hand tools are old and well known in the art. There is a countless variety of hand tools which are used for a countless variety of tasks such as working on cars and machinery, various house projects, building or assembling device, and the like. Commonly known hand tools include wrenches, sockets, screw drivers, scrapers, chisels, paint brushes, just to name a few.

It is common to store and organize these hand tools in a toolbox prior to use. While toolboxes are useful for pre-use organization and storage, once removed from the toolbox for use, there is no way to organize hand tools during use which often leads to losing or misplacing hand tools during use. This is because conventional hand tools lack a method or means to be kept in a convenient place near where they are being used. When a hand tool is lost or misplaced during use this causes inefficiency, frustration and may even prevent the project from being completed.

Accordingly, there exists a need in the art for a device that addresses these deficiencies.

Therefore, an objective of the present invention is to provide a convenient method and means for storing and organizing hand tools during use.

Another object of the present invention is to provide an inexpensive method and means for reducing lost or misplaced hand tools.

Yet another object of the present invention is to provide a method and means for storing and organizing hand tools during use that is adaptable to most hand tools.

Another object of the present invention is to provide a method and means that improves the efficiency of completing projects with hand tools.

Yet another object of the present invention is to provide a method and means that reduces the potential for frustration when using hand tools.

These and other objects, features, or advantages of the present invention will become apparent from the specification and claims.

SUMMARY OF THE INVENTION

A magnetic holding device having an elongated body which extends between a tip and a locking head. A saddle is connected to the elongated body. Said saddle having a magnet connected thereto. In operation the elongated body is wrapped around the body of a hand tool and the tip is passed through an opening in the locking head. The elongated body is passed through the locking head until the magnetic holding device is tightened over the hand tool. Once in place the magnetic holding device holds the hand tool in a convenient place near where the hand tool is being used by connecting the magnet to any metal object. In this way the magnetic holding device provides the advantage of reducing the potential for lost or misplaced hand tools by allowing for easy organization and placement of hand tools during use.

DETAILED DESCRIPTION OF THE INVENTION

Figure 1:
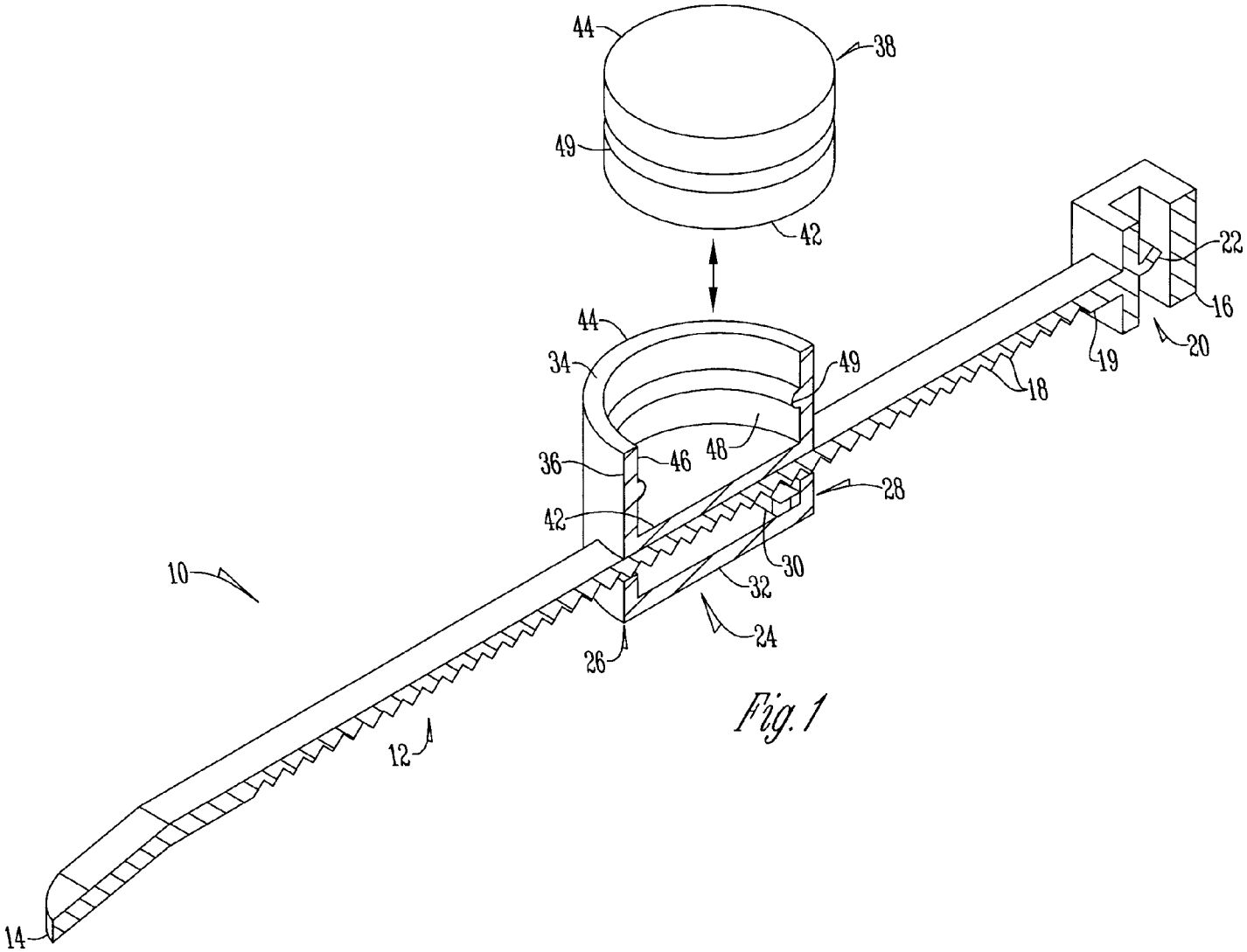
FIG. 1 is a perspective view of a magnetic holding device.

With reference to the figure, a magnetic holding device 10 is presented. The magnetic holding device 10 has an elongated body 12 which extends between a tip 14 and a locking head 16. One side of the elongated body 12 has a plurality of stepped or angled serrations 18 which are positioned within a recessed groove 19. Locking head 16 has an opening 20 which is sized and shaped to allow the elongated body 12 to pass therethrough with frictional engagement and close tolerances. To lock the elongated body 12 in a closed position, positioned within the opening 20 is a lever arm 22. Tip 14 narrows as it extends away from locking head 16 so as to allow for easier insertion of the tip 14 within opening 20 of locking head 16. In one arrangement, elongated body 12 is a conventional cable tie or Zip Tie, which is well known in the art which is permanently attached once elongated body 12 is tightened through locking head 16. Alternatively, the Zip Tie is re-tightenable, removable and replaceable. That is, the Zip Tie can be tightened for use on one tool and then loosened for use on a different tool which provides an additional advantage of being used on multiple tools.

Connected to the elongated body 12 is at least one saddle 24, if not two or more. In one arrangement, saddle 24 is integrally and permanently connected to elongated body 12 or molded directly within or onto elongated body 12 in a permanent and non-removable fashion. In another arrangement, saddle 24 is a separate piece which is removably and replaceably installed onto elongated body 12. Saddle 24 has a saddle body 26 which has an opening 28 therethrough which is sized and shaped to allow the elongated body 12 to pass therethrough with frictional engagement and close tolerances. In one arrangement a firm and tight frictional engagement is desired. Additionally, to lock the saddle onto the elongated body 12, positioned within the opening 28 is a lever arm 30 which operates similarly or identically to lever arm 22 of elongated body 12.

In one arrangement, saddle body 26 is cylindrical in shape having a flat bottom surface 32 and a flat top surface 34, which extend in parallel spaced alignment. Saddle body 26 has a rounded sidewall 36 which extends perpendicularly between flat bottom surface 32 and flat top surface 34 thereby forming a cylindrical shape. Alternatively, saddle body 26 takes any other shape such as a cube shape, a rectangle, an oval, a sphere or any other three dimensional shape.

In one arrangement, opening 28, which when viewed from the side, is square or rectangular so as to match, mate or frictionally engage, or firmly frictionally engage with elongated body 12, is positioned near the flat bottom surface 32 which causes flat top surface 34 to extend upwardly and away from elongated body 12.

Connected to saddle body 26 is magnet 38. In one arrangement, magnet 38 is cylindrical in shape having a flat bottom surface 42 and a flat top surface 44, which extend in parallel spaced alignment to one another. Magnet 38 has a rounded sidewall 46 which extends perpendicularly between flat bottom surface 42 and flat top surface 44, thereby forming a cylindrical shape. In this arrangement, saddle body 26 has a cavity 48 which matches the size and shape of magnet 38 such that magnet 38 is matingly, frictionally, directly, and/or firmly frictionally received within cavity 48. To ensure magnet 38 does not come out of cavity 48, a high pressure press is used to force magnet 38 into cavity 48, thereby permanently forcing and fusing magnet 38 within cavity 48. In this arrangement, once magnet 38 is placed within cavity 48, the flat top surface 34 of saddle body 26 is flushly aligned with the flat top surface 44 of magnet 38 such that the flat top surface 44 of magnet 38 is exposed allowing for direct contact to a connecting surface. This provides the strongest possible connection as there is no distance or material between magnet 38 and the surface to which it connects to attenuate or diffuse the magnetic force of magnet 38.

To help hold magnet 38 within cavity 48 an adhesive element such as glue or the like is connected to the exterior surface of magnet (sidewall 46 and bottom surface 42) and the interior surface of cavity 48, and/or positioned therebetween. Alternatively, any other bonding or binding method or composition is used, such as welding, sonic welding, infusion, adhesion, frictional engagement, or the like.

To improve adhesion and prevent the magnet 38 from accidently escaping cavity 48, the exterior surface of magnet 38 (sidewall 46 and bottom surface 42) is roughened, abraded or has at least one notch, groove or surface feature therein which can take any size, shape or design. In addition, the interior surface of cavity 48 is similarly roughened, abraded or has at least one notch, groove or surface feature therein which can take any size, shape or design. The presence of these features allows the magnet 38 to have a stronger and more rugged and durable connection within the cavity 48 thereby preventing breakage or accidental removal of the magnet 38. The use of an adhesive fills these features thereby locking the magnet 38 within cavity 48. Alternatively, magnet 38 is formed or molded within cavity 44 in which case the material saddle body 26 is made of flows into the surface features of magnet 38 thereby locking magnet 38 within cavity 44.

To reduce the possibility further that magnet 38 comes out of or withdraws from cavity 48 of saddle 24, larger features are positioned in the exterior wall 46 of magnet 38. As one example, a cylindrical cut-out 49 is positioned in the exterior cylindrical surface wall of magnet 38. In this arrangement, when the material of saddle 24 is molded around magnet 38, the material of saddle 24 flows into this cylindrical cut-out 49 thereby permanently locking magnet 38 into cavity 48. Or alternatively, the cavity 48 of saddle 24 is formed with a mating feature which fits within cut-out 49. In this arrangement, magnet 38 is forced within cavity 48, in doing so, the material of saddle 24 stretches, until the magnet 38 is fully received within cavity 48 at which point, the mating feature snaps into cut-out 49. This provides a permanent, rugged, durable, and non-removable saddle 24 and magnet 38 arrangement.

Figure 2:
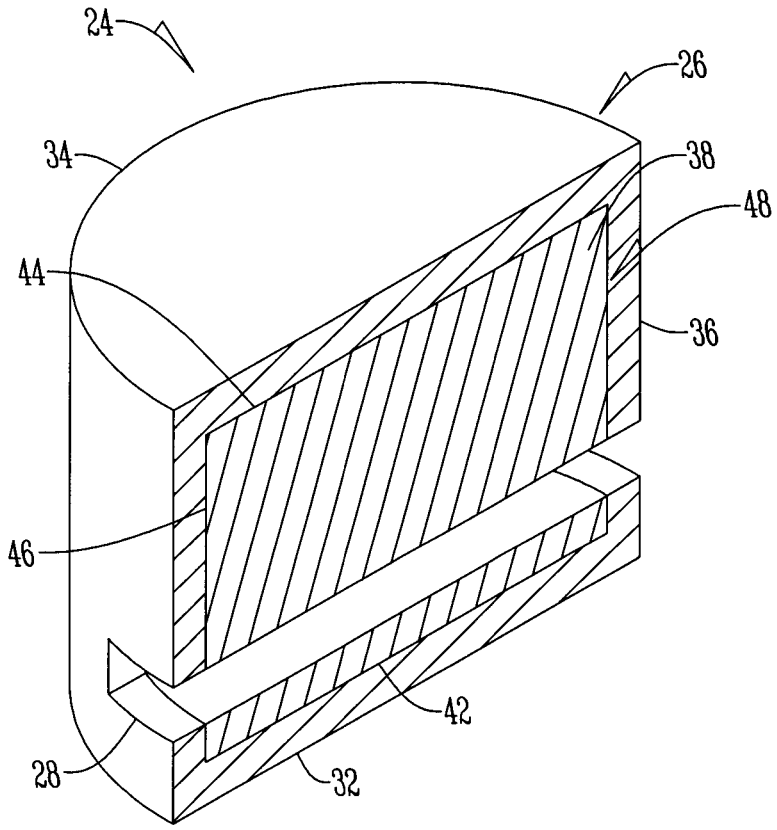
FIG. 2 is a perspective view of a magnetic holding device.
Figure 3:
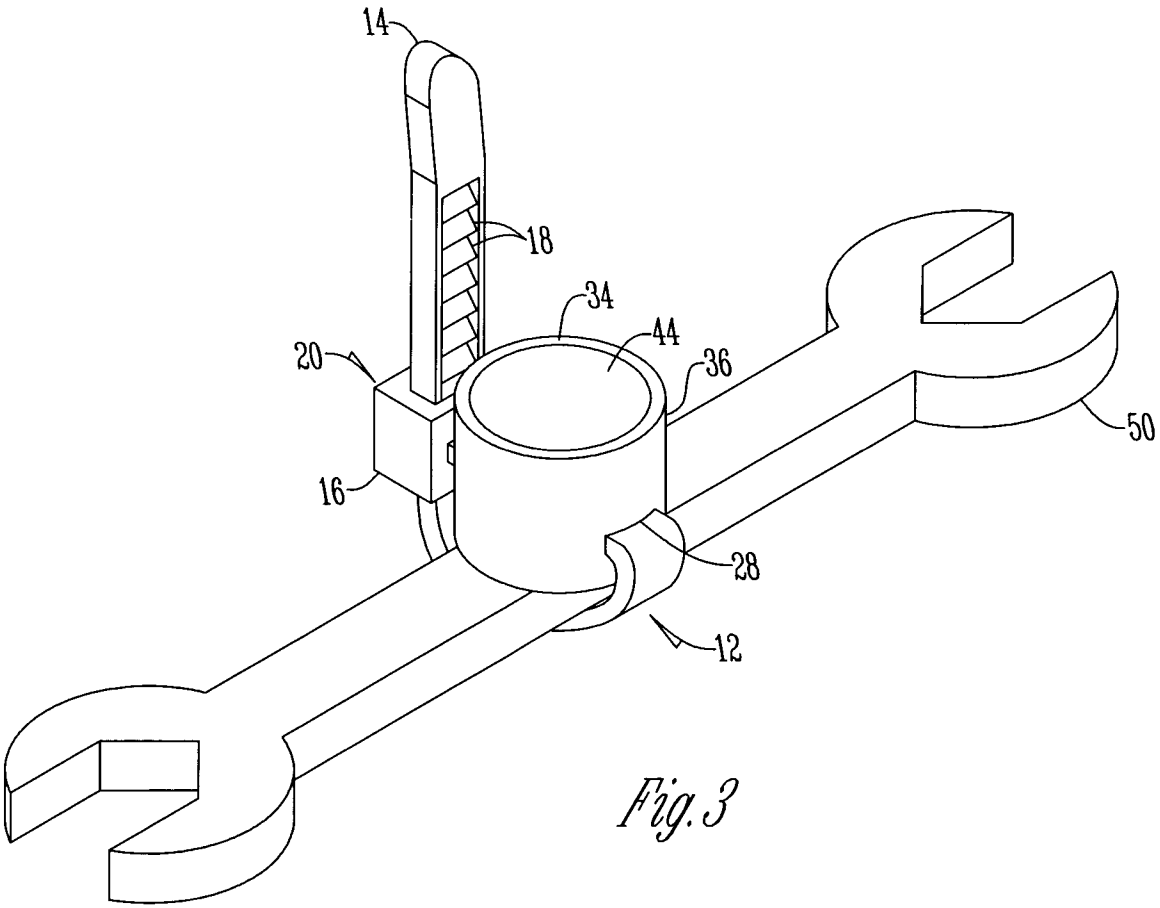
FIG. 3 is a perspective view of a magnetic holding device.

With reference to FIG. 2, in an alternative arrangement, and to prevent magnet 38 from escaping saddle body 26, magnet 38 is fully encapsulated within the material of saddle body 26. In this arrangement there is no exposed surface of magnet 38. However, the flat top surface 44 of magnet 38 is positioned adjacent to and as near as the flat top surface 34 of saddle body 26 so as to provide the strongest possible magnetic connection to a connecting surface and to reduce the amount of attenuation of the magnetic force.

In an alternative arrangement, to further reduce the possibility that magnet 38 is removed from cavity 48 of saddle 24, the opening 28 passes through both the saddle body 26 as well as magnet 38. In this arrangement, when in use, the elongated body pulls on the magnet 38 directly, thereby reducing or eliminating any separating force between saddle 24 and magnet 38.

In one arrangement elongated body 12 and saddle body 26 are made of a durable plastic or composite material. Whereas, magnet is made of a ferrous magnet, rare earth magnet, supermagnet or any other magnetic or magneticly conductive material.

In operation, the magnetic holding device 10 is assembled by selecting a zip tie of the appropriate size, shape, length and strength. In the arrangement wherein the saddle 24 is not molded directly as a part of elongated body 12, tip 14 of the elongated body 12 is passed through the opening 28 in saddle 24 ensuring that any lever arm 30 is aligned on the side of elongated body 12 having serrations 18 therein. As the tip 14 passes through opening 28 in saddle body 26 lever arm 30 engages serrations 18 in the surface of elongated body 12. Lever arm 30 deflects to allow each serration 18 to pass therethrough thereby locking saddle body 26 on elongated body 12 and preventing saddle 24 from sliding off of elongated body 12.

Once saddle 24 is installed on elongated body 12, elongated body is wrapped around the body of hand tool 50 ensuring that the flat bottom surface 32, 42 of saddle body 26 and magnet 38 face towards the body of hand tool 50. Similarly, flat top surface 34, 44 faces away from hand tool 50 thereby allowing for quick and easy connection to any connecting surface. Once in this position, tip 14 of elongated body is passed through opening 20 of locking head 16. As the tip 14 passes through opening 20 lever arm 22 engages serrations 18 in the surface of elongated body 12. Lever arm 22 deflects to allow each serration 18 to pass therethrough thereby locking elongated body 12 on hand tool 50. The elongated body 12 is tightened preventing magnetic holding device 10 from coming off of hand tool 50. Thereafter, the tip 14 side of the elongated body is removed with a cutting device.

Alternatively, the tip 14 and elongated body 12 are passed through a hole 52 or opening in hand tool 50. This hole or opening 52 can be premade, such as the handle of a scissors, or it can be drilled by the user, such as through the handle of a typical screwdriver, as one example.

This arrangement is adjustable to almost any hand tool 50 regardless of its size or shape. Note, the use of the term "hand tool" is meant to be non-limiting and is intended to mean any object. For heavier applications, additional saddles 24 are added.

Figure 4:
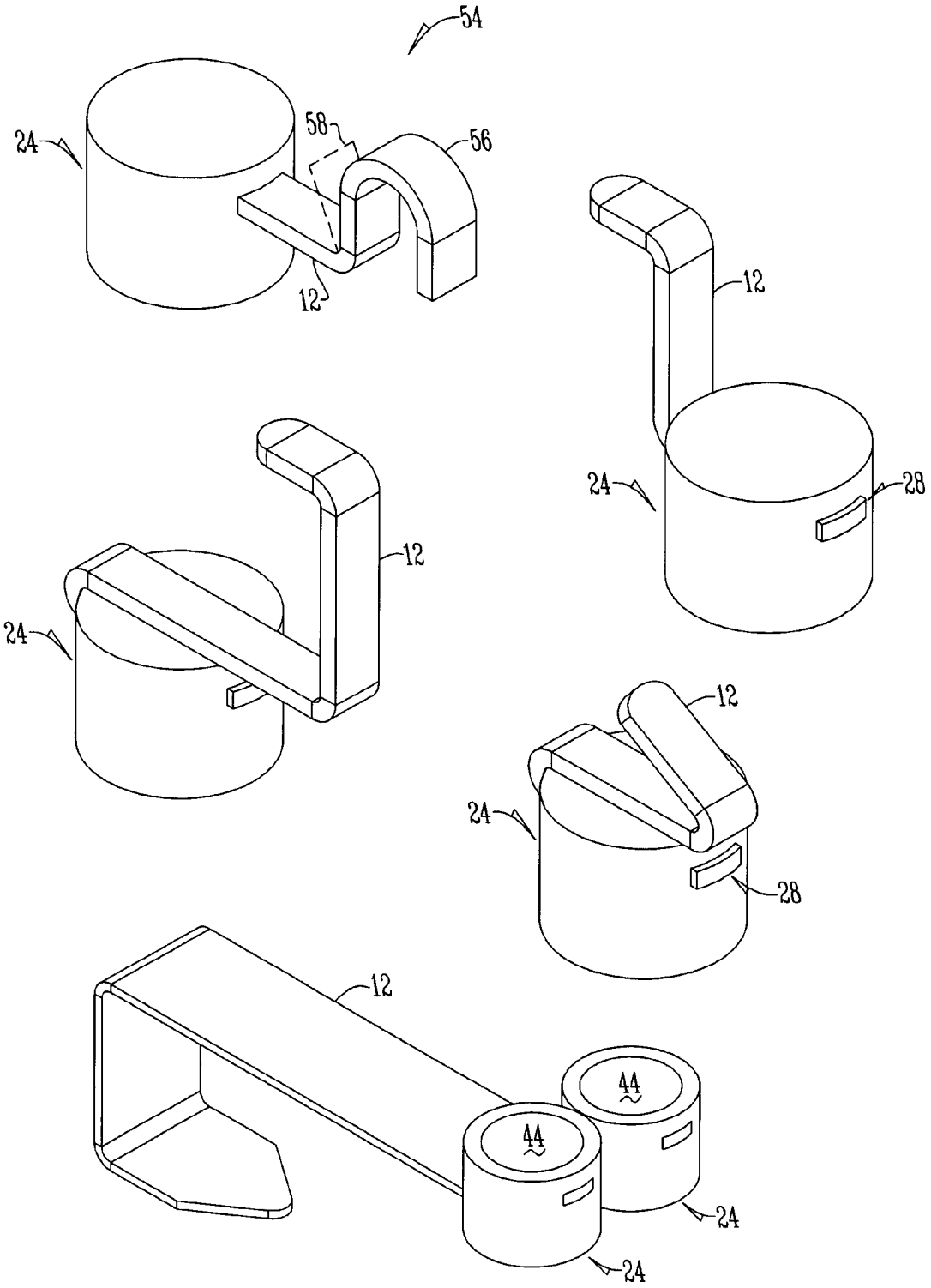
FIG. 4 is a perspective view of a magnetic holding device.

In an alternative arrangement, with reference to FIG. 4, a clip, spring, holder, clasp or hook 54 is connected to saddle 24 for attachment to metallic surfaces such as a refrigerator door. In this arrangement, an elongated body 12 is connected to opening 28 of saddle 24 and extends outwardly therefrom. In this arrangement, elongated body 12 terminates in a bendable and resilient portion 56. In the arrangement depicted in FIG. 4, resilient portion 56 is turned toward magnet 38, so as to provide a clipping force between the surface it magnetic holding device 10 is connected to and resilient portion 56. Alternatively, resilient portion 56 is bent in the opposite direction along hidden line 58 to form a hook for hanging objects therefrom. In one arrangement, this elongated body 58 is made of a metallic material so as to be durable, rugged and resilient, however any other suitable material is hereby contemplated such as plastic, composite or the like.

In use, when the user is done using hand tool 50, the user simply connects the flat top surface 34, 44 of saddle body 26 to any metallic surface. The magnetic pull of magnet 38 holds the hand tool 50 in place thereby preventing lost or misplaced hand tools. In addition, by providing an opening 28 which passes through the magnet 38 itself, this improves the longevity of the device 10. Also, by providing an opening 28 which tightly or closely fits elongated body 12, this prevents any wobble between elongated body 12 and saddle 24, and provides for a tighter, stronger and better connection. In addition, this arrangement provides for more material of saddle 24 being positioned around elongated body, thereby extending the longevity of device 10 while improving its strength. In addition, by providing the arrangement where saddle 24 has a flat bottom surface 32, and opening 28 passing through the body of saddle 24, this allows saddle 24 to be strongly tightened against tools having a flat surface (which is the majority of tools) which allows for easier alignment of tools (that is the magnet 38 is positioned on the proper side of the tool 50 as well as ensuring the proper side of tool 50 faces is aligned properly), and prevents the tool 50 from wobbling, tilting or moving in relation to elongated body 12 and saddle 24. In addition, by forming the saddle 24 in a simple cylindrical shape, the saddle is strong and robust, resists rotation, and prevents the saddle 24 from being hung-up on surrounding objects, like a user's pocket.

From the above discussion it will be appreciated that the magnetic holding device 10 presented offers many advantages and improvements over the prior art. The magnetic holding device 10 provides a convenient method and means for storing and organizing hand tools 50 when in use. The magnetic holding device 10 reduces the potential for lost or misplaced hand tools 50 during use which improves efficiency and reduces frustration. These uses include:

Work—to organize tools, wrenches, sockets, ratchets, hammers, pliers, screwdrivers, tape measures. Holds and organizes precision equipment on machines, wire and cable holder. Install on tools to hold screws, nuts, and bolts from getting lost.

Office—to organize desk, desk drawers, hang memos, hang posters, hang notes, use on poster boards for erasers, markers, pens, hold stapler.

RV/Camping—use in the RV to organize endless items that get lost easily, camping gear, grill lighter, keys.

Household—kitchen—organize things on the refrigerator, notes, kitchen utensils, organize kitchen drawers, organize kitchen counter tops, cup holder.

Household—bathroom—toothbrush holder, shaver holder, medicine holder.

Household—laundry room—holds and organize brooms, mops, measuring detergent cups, soaps.

Household—bedrooms—cards, pictures, jewelry, watches.

Garage and outdoors—grill utensils, cars and trucks.

Medical industry—cane holder, pill holder.

Personal item uses—cell phone, keys.

It will be appreciated by those skilled in the art that other various modifications could be made to the device without parting from the spirit and scope of this invention. All such modifications and changes fall within the scope of the invention and are intended to be covered thereby.

What is claimed:

1. A magnetic holding device comprising:

an elongated body extending between a tip and a head;

the elongated body having a plurality of serrations thereon;

the head having an opening therein with a first lever arm positioned within the opening;

a saddle connected to the elongated body;

the saddle having a flat top surface and a flat bottom surface which extend in parallel spaced alignment to one another;

an opening passes through the saddle, wherein the opening through the saddle is sized and shaped to tightly, frictionally, and directly engage the elongated body with close tolerances, so as to inhibit rotation or wobble of the saddle on the elongated body;

a second lever arm positioned within the opening of the saddle; a cavity is positioned within the saddle;

a magnet is positioned within the cavity; and wherein the elongated body passes through the opening of the saddle and the opening of the head.

2. The magnetic holding device of claim 1 further comprising wherein the fiat top surface of the magnet and the flat top surface of the saddle are positioned in flush alignment with one another.

3. The magnetic holding device of claim 1 wherein the device is configured to be tighten around a tool, such that the flat bottom surface of the saddle is configured to flushly engage a flat surface of the tool.

4. The magnetic holding device of claim 1 wherein the opening in the saddle aligns with an opening in the magnet.

5. The magnetic holding device of claim 1 wherein the saddle is in the shape of a cylinder.

6. The magnetic holding device of claim 1 wherein the magnet is encapsulated within the saddle.

7. The magnetic holding device of claim 1 wherein the magnet has a surface feature in its exterior surface so as to help hold it within the cavity of the saddle.

8. The magnetic holding device of claim 1 wherein the magnet is pressed into the cavity.

9. The magnetic holding device of claim 1 wherein the opening in the saddle is positioned near the flat bottom portion.

10. The magnetic holding device of claim 1 wherein the opening of the saddle is positioned between the bottom surface of the saddle and the magnet.

11. The magnetic holding device of claim 1 further comprising a second saddle connected to the elongated body.

12. The magnetic holding device of claim 1 wherein the magnet is force fused to the saddle.

13. The magnetic holding device of claim 1 wherein the magnet has a cylindrical cut-out positioned in an exterior cylindrical surface wall of the magnet and the magnet is formed within the saddle such that the saddle flows into the cylindrical cut-out thereby locking the magnet within the cavity of the saddle.

14. A magnetic holding device comprising:

an elongated body extending between a tip and a head;

the elongated body having a plurality of serrations thereon;

the head having an opening therein with a lever arm positioned within the opening;

a saddle connected to the elongated body;

a cavity is positioned within the saddle;

a magnet is positioned within the cavity;

an opening that passes through the saddle and the magnet;

the magnet has an exterior surface with a feature therein which serves to hold the magnet within the cavity and prevent removal of the magnet from the cavity; and wherein the elongated body passes through the opening of the saddle and the magnet, and the opening of the head.

15. The magnetic holding device of claim 14 wherein the exterior surface feature of the magnet is a roughed exterior.

16. The magnetic holding device of claim 14 wherein the magnet is molded into the cavity of the saddle.

17. The magnetic holding device of claim 14 wherein the exterior surface feature of the magnet is a notch that is received within a groove in the interior surface of the cavity.

18. A magnetic holding device comprising:

a saddle having an opening therein;

the saddle having a cylindrical shape, with a flat front surface and a flat back surface;

a cavity positioned within the front surface of the saddle;

a magnet is formed within the cavity and having an exterior feature positioned on the exterior surface of the magnet such that the saddle flows into the exterior feature thereby locking the magnet within the cavity of the saddle;

an elongated body connected to the opening and extending outwardly therefrom;

the elongated body having a bendable and resilient portion that teiminates in a hook portion; and the elongated body having a plurality of serrations wherein the plurality of serrations are positioned within a recessed groove.

19. The magnetic holding device of claim 18 wherein the hook portion is resilient and bends towards the flat front surface of the saddle thereby providing a clipping force.

20. The magnetic holding device of claim 18 wherein the hook portion is rigid and is bent away from the flat front surface of the saddle and toward the saddle thereby providing an upwardly angled hook.

* * * * *